US012529192B2

(12) United States Patent
Philipp et al.

(10) Patent No.: US 12,529,192 B2
(45) Date of Patent: Jan. 20, 2026

(54) MACHINE AND METHOD WITH A TAMPING UNIT

(71) Applicant: PLASSER & THEURER EXPORT VON BAHNBAUMASCHINEN GESELLSCHAFT M.B.H., Vienna (AT)

(72) Inventors: Thomas Philipp, Leonding (AT); Josef Hofstätter, Puchenau (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 588 days.

(21) Appl. No.: 18/004,094

(22) PCT Filed: Jun. 2, 2021

(86) PCT No.: PCT/EP2021/064804
§ 371 (c)(1),
(2) Date: Jan. 3, 2023

(87) PCT Pub. No.: WO2022/002520
PCT Pub. Date: Jan. 6, 2022

(65) Prior Publication Data

US 2023/0257939 A1 Aug. 17, 2023

(30) Foreign Application Priority Data

Jul. 3, 2020 (AT) ..... A 50566/2020

(51) Int. Cl.
*E01B 27/16* (2006.01)

(52) U.S. Cl.
CPC ..... *E01B 27/16* (2013.01); *E01B 2203/12* (2013.01)

(58) Field of Classification Search
CPC ..... E01B 27/12; E01B 27/20; E01B 27/17; E01B 2203/12; E01B 27/16
See application file for complete search history.

(56) References Cited

U.S. PATENT DOCUMENTS 2,971,472 A * 2/1961 Plasser ..... E01B 27/12 104/12
3,000,328 A * 9/1961 Plasser ..... E01B 27/12 104/12

(Continued)

FOREIGN PATENT DOCUMENTS

AT 507896 B1 * 9/2010 ..... E01B 27/16
AT 513034 A4 1/2014

(Continued)

*Primary Examiner* — Paul N Dickson
*Assistant Examiner* — Maxwell L Meshaka
(74) *Attorney, Agent, or Firm* — Laurence A. Greenberg; Werner H. Stemer; Ralph E. Locher

(57) ABSTRACT

A tamping machine has a tamping unit for simultaneously tamping sleepers of a track that are positioned directly behind one another. Tamping unit segments are arranged one behind the other. Each tamping unit segment has a height-adjustable tamping tool carrier on which opposing tamping tools are mounted that are coupled to a vibration drive via squeezing cylinders. The respective vibration drive has an eccentric shaft with first and second eccentric discs, the axes of symmetry of which, together with a common axis of rotation, span two eccentric planes that enclose a relative angle to one another. A first squeezing cylinder is mounted on the first eccentric disc. An opposing second squeezing cylinder is mounted on the second eccentric disc. Cylinder axes of the opposing squeezing cylinders enclose a position angle which is approximated to the relative angle of the eccentric planes.

16 Claims, 5 Drawing Sheets

(56) References Cited

U.S. PATENT DOCUMENTS

| | | | | | |
|---|---|---|---|---|---|
| 3,372,651 | A * | 3/1968 | Plasser | E01B 27/16 | 104/12 |
| 4,010,692 | A * | 3/1977 | Goel | E01B 27/16 | 104/12 |
| 4,130,063 | A * | 12/1978 | Theurer | E01B 27/16 | 104/12 |
| 4,258,627 | A * | 3/1981 | Theurer | E01B 27/16 | 104/12 |
| 4,312,275 | A * | 1/1982 | Theurer | E01B 27/16 | 104/12 |
| 4,440,089 | A | 4/1984 | Cicin-Sain et al. | | |
| 5,033,945 | A | 7/1991 | Kolb | | |
| 9,546,453 | B2 | 1/2017 | Springer | | |
| 9,803,323 | B2 | 10/2017 | Hofstaetter | | |
| 10,914,040 | B2 * | 2/2021 | Hofstaetter | E01B 27/16 | |
| 11,053,644 | B2 * | 7/2021 | Philipp | E01B 27/16 | |
| 11,542,666 | B2 * | 1/2023 | Philipp | E01B 27/16 | |
| 11,834,794 | B2 * | 12/2023 | Philipp | E01B 27/16 | |
| 12,049,731 | B2 * | 7/2024 | Philipp | E01B 27/17 | |
| 12,188,184 | B2 * | 1/2025 | Philipp | E01B 27/16 | |
| 12,195,926 | B2 * | 1/2025 | Philipp | E01B 27/16 | |
| 2010/0064928 | A1 * | 3/2010 | Theurer | E01B 27/17 | 104/10 |
| 2015/0083014 | A1 | 3/2015 | Pritzl | | |
| 2019/0055698 | A1 * | 2/2019 | Hofstaetter | E01B 27/13 | |
| 2019/0137356 | A1 * | 5/2019 | Philipp | G01M 13/00 | |
| 2019/0271119 | A1 * | 9/2019 | Philipp | E01B 27/16 | |
| 2020/0141063 | A1 * | 5/2020 | Philipp | E01B 27/16 | |
| 2020/0392672 | A1 * | 12/2020 | Philipp | E01B 27/16 | |
| 2021/0395953 | A1 * | 12/2021 | Philipp | E01B 27/20 | |
| 2022/0034043 | A1 * | 2/2022 | Philipp | E01B 27/16 | |
| 2022/0056647 | A1 * | 2/2022 | Philipp | E01B 27/17 | |
| 2023/0151556 | A1 * | 5/2023 | Philipp | E01B 35/00 | 104/12 |
| 2023/0257939 | A1 * | 8/2023 | Philipp | E01B 27/16 | 104/12 |
| 2024/0254698 | A1 * | 8/2024 | Hofstaetter | E01B 27/17 | |

FOREIGN PATENT DOCUMENTS

| | | | | | |
|---|---|---|---|---|---|
| AT | 18243 | U1 * | 6/2024 | E01B 27/17 | |
| CN | 118498132 | A * | 8/2024 | E01B 27/16 | |
| EP | 0050889 | A1 | 5/1982 | | |
| EP | 0195882 | B1 * | 8/1988 | E01B 27/16 | |
| EP | 0371305 | A1 | 6/1990 | | |
| GB | 2451310 | A * | 1/2009 | G07C 3/00 | |
| WO | WO-2011023257 | A1 * | 3/2011 | E01B 27/16 | |
| WO | 2014063770 | A1 | 5/2014 | | |
| WO | WO-2018149628 | A1 * | 8/2018 | E01B 27/16 | |

* cited by examiner

MACHINE AND METHOD WITH A TAMPING UNIT

SPECIFICATION

Field of Technology

The invention relates to a machine with a tamping unit for the simultaneous tamping of a plurality of sleepers of a track positioned immediately one behind the other by means of a plurality of tamping units arranged immediately one behind the other with respect to a longitudinal direction of the machine, wherein each tamping unit comprises a height-adjustable tamping tool carrier on which opposing tamping tools are mounted, the tamping tools being coupled to a vibration drive arranged on the tamping tool carrier via squeezing cylinders. The invention further relates to a method for operating the machine.

Prior Art

In order to restore or maintain a predefined track geometry, ballasted tracks are regularly worked by means of tamping machines. In the process, the tamping machine travels along the track and lifts the track panel formed of sleepers and rails to a target level by means of a lifting and lining unit. The new track position is fixed by tamping the sleepers by means of a tamping unit. The tamping unit comprises tamping tools with tamping tines which, during tamping, penetrate the ballast bed while being subjected to vibration and being squeezed towards each other. In the process, the ballast is compacted below the respective sleeper.

Tamping units for the simultaneous tamping of a plurality of sleepers are particularly used in plain line tamping machines. Given the resulting high working speed, the track can be maintained in short track possessions. Modern tamping machines are also characterised by low wear effects on both the tamping unit and the ballast.

A generic machine with at least two tamping unit segments arranged one behind the other is known from AT 513 034 A1. Each tamping unit segment is arranged height-adjustably in a shared tamping unit carrier. A tamping cycle begins with the tamping unit segments being lowered simultaneously. The simultaneous lowering of adjacent tamping unit segments for the tamping of adjacent sleepers in the longitudinal direction of the machine takes place with a time delay. This facilitates in particular the insertion of directly adjacent tamping tines penetrating a shared sleeper crib.

SUMMARY OF THE INVENTION

The object of the invention is to improve a machine of the kind mentioned above in such a way that in addition to a reduced wear effect, a low noise emission is achieved. Additionally, a corresponding method for operating the improved machine is to be indicated.

According to the invention, these objects are achieved by the features of the independent claims. Dependent claims indicate advantageous embodiments of the invention.

The respective vibration drive comprises an eccentric shaft with a first eccentric disc and a second eccentric disc, the axes of symmetry of which, together with a common axis of rotation, span two eccentric planes which enclose a relative angle to one another, wherein a first squeezing cylinder is mounted on the first eccentric disc, wherein an opposing second squeezing cylinder is mounted on the second eccentric disc, and wherein cylinder axes of the opposing squeezing cylinders enclose a position angle which is approximated to the relative angle of the eccentric planes. In this way, the angular positions of the eccentric discs and the squeezing cylinders are harmonised with each other in order to achieve a mass balance for the vibrating parts of the tamping unit. In particular, the inertial forces of the synchronously vibrating tamping tools cancel each other out. As a result, the tamping unit runs more quietly.

The squeezing cylinders are not aligned horizontally, which means that the relative angle is not equal to 180°. In the case of the obliquely linked squeezing cylinders, the arrangement according to the invention causes optimum vibration of the tamping tools which synchronously move towards each other in opposite directions. Specifically, the vibrations of the two opposing tamping tools are subject to a phase shift that causes the respective reversal points to be reached at the same time. The acceleration and deceleration forces of the vibrating masses of the tamping tools and the vibrating partial masses of the squeezing cylinders cancel each other out.

Tamping tines arranged at the lower free ends of the tamping tools vibrate synchronously towards each another in opposite directions with a maximum relative movement. This results in maximum energy input into the ballast bed without setting the tamping tool carrier and an associated tamping unit suspension into disturbing reaction vibrations. The tamping unit and the machine are thus under low vibration stress. Both the components of the tamping unit and the ballast grains of the ballast bed to be compacted are hence protected. Together, the targeted introduction of vibrations into the ballast bed and the mass balance result in a reduction of noise emission compared to known designs of tamping units.

Advantageously, each tamping unit segment comprises at least one squeezing cylinder, the cylinder axis of which is oriented obliquely downwards, in particular with an angle of inclination greater than 20° with respect to a horizontal line. In this way, a particularly narrow design of the individual tamping unit segments in the longitudinal direction of the machine is possible, whereby even tracks with small sleeper spacing can be worked simultaneously with all tamping unit segments.

In an advantageous further development, the respective eccentric shaft is connected to a flywheel. During operation, the eccentric shaft is driven together with the flywheel at a preset rotational speed. The flywheel has a stabilising effect on the rotational speed. Specifically, the retroactive moments of the vibrating squeezing cylinders and tamping tools are balanced with the kinetic energy temporarily stored in the flywheel during a vibration cycle. The vibration amplitude of the tamping tools is maintained regardless of the stiffness of the ballast bed.

For further improvement of the mass balance, the rotating unit formed of the eccentric shaft and the flywheel is designed in such a way that a common centre of mass with respect to the axis of rotation lies opposite to the axes of symmetry of the two eccentric discs. In this way, the rotating unit acts as a balancing mass to the moving mass of the squeezing cylinders of the opposing tamping tools.

In an advantageous embodiment of the invention, the tamping unit comprises—with respect to the longitudinal direction of the machine-front and rear tamping unit segments with asymmetrically arranged squeezing cylinders and middle tamping unit segments with symmetrically arranged squeezing cylinders. The middle tamping unit segments have a particularly narrow design so that also sleepers with small sleeper spacings can be tamped at the same time. On one half facing the middle tamping unit segments, the front and rear tamping unit segments have a narrow design as well. The halves of the front and rear tamping unit segments facing away from the middle tamping unit segments have a wider design to achieve a larger opening width between the opposing tamping tools.

In this embodiment of the invention, it is useful if the front and rear tamping unit segments each have an eccentric shaft with different eccentricities. Different lever ratios of the opposing tamping tools and the different eccentricities are harmonised with each other so that the vibration amplitudes of the freely vibrating tamping tine ends are of equal size.

The respective opposing tamping tools of the front and rear tamping unit segments are advantageously mounted on the associated tamping tool carrier with vertically spaced pivoting joints. Preferably, the joints of the tamping tools facing the middle tamping unit segments are arranged lower in order to achieve a more narrow design while maintaining the same lever ratio.

Furthermore, it is useful if the front and rear tamping unit segments each have a half facing the middle tamping unit segments, which is constructed according to a symmetry half of the middle tamping unit segments. This simplifies the structure of the tamping unit and facilitates the actuation of the individual tamping unit segments. In addition, the number of individual spare parts is reduced.

Advantageously, the middle tamping unit segments and the halves of the front and rear tamping unit segments facing the middle tamping unit segment are each connected to a first squeezing pressure system, and the halves of the front and rear tamping unit segments facing away from the middle tamping unit segments are each connected to a second squeezing pressure system. The different squeezing pressure systems enable the presence of the same static and dynamic squeezing forces in all tamping tools.

A further improvement provides that a half of the respective front or rear tamping unit segment facing away from the middle tamping unit segments comprises a squeezing cylinder with an increased stroke in order to tamp twin sleepers. In this way, the tamping unit can be used universally and all sleeper arrangements occurring on a track line can be worked on.

In addition, it is advantageous if several tamping tools arranged next to each other crosswise to the longitudinal direction of the machine, together with the associated squeezing cylinder, form a jointly actuatable squeezing group. This applies to the tamping unit segments that are arranged next to each other, tamping one sleeper on either side of both rails of the track. During operation, the squeezing groups are actuated together in order to ensure a uniform compaction process along one sleeper.

In the method according to the invention for operating the described machine, the vibration drive and the squeezing cylinders of the respective tamping unit segment are actuated in such a way that the position angle of the squeezing drives fluctuates within a range around the relative angle of the eccentric planes of the associated eccentric shaft. In this way, the current position angle remains approximated to the relative angle during a tamping process. Particularly in a middle pivot position of the squeezing drives, the position angle corresponds to the relative angle. The vibrating masses of the respective tamping unit segment then vibrate synchronously in opposite directions, resulting in a mass balance. This minimises stress on the tamping unit as well as noise development.

A further development of the method provides that each eccentric shaft is driven by means of an associated vibration drive motor and that all vibration drive motors are actuated by means of a shared control equipment for a synchronous operation. The vibration movements of the tamping unit segments are thus harmonised with each other in order to optimise the smooth operation of the entire tamping unit.

In addition, it is advantageous if the respective eccentric shaft is driven at a variable rotational speed depending on a height position of the associated tamping unit segment. Prior to a tamping process, all tamping unit segments are in an initial position above the track. In this position, the rotational speed of the respective eccentric shaft remains reduced to further reduce noise development. Only when the height position is changed in the course of a lowering process is there an increase to a working rotational speed that is greater during a penetration process than during squeezing.

A further improvement provides that squeezing groups arranged next to each other crosswise to the longitudinal direction of the machine are actuated with a shared control signal. In this way, a uniform compaction process takes place along one sleeper.

Advantageously, during a squeezing process, the middle tamping unit segments and the halves of the front and rear tamping unit segments facing the middle tamping unit segments are each subjected to a first squeezing pressure, while the halves of the front and rear tamping unit segments facing away from the middle tamping unit segments are each subjected to a second squeezing pressure. The different squeezing pressures enable the presence of the same static and dynamic squeezing forces in all tamping tools.

BRIEF DESCRIPTION OF THE DRAWINGS

In the following, the invention is explained by way of example with reference to the accompanying figures. The following figures show in schematic illustrations.

DESCRIPTION OF THE EMBODIMENTS

Figure 1:
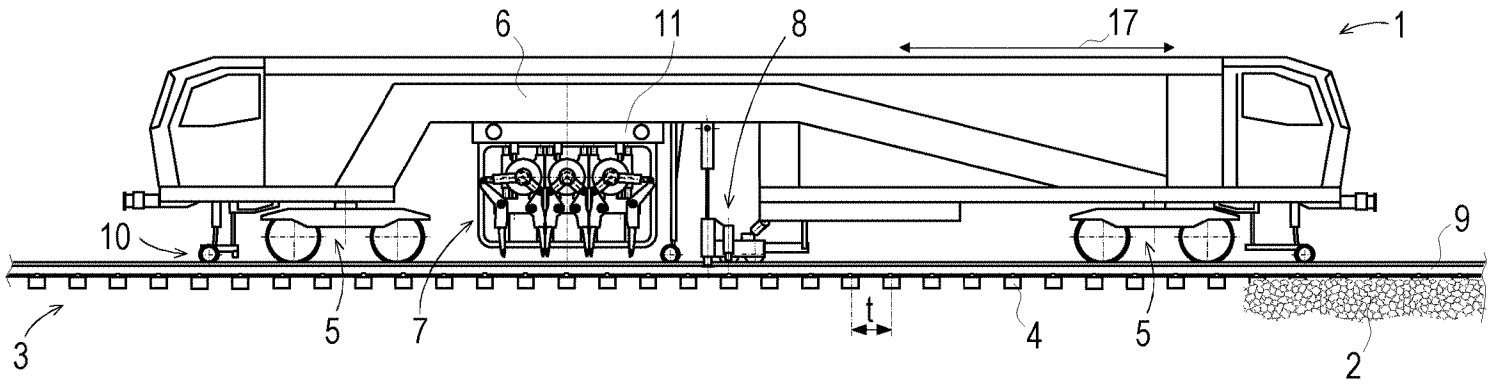
FIG. 1 Machine with tamping unit

The machine 1 shown in FIG. 1 is designed as a plain line tamping machine for simultaneous tamping of three sleepers 4 supported on a ballast bed 2 of a track 3. The machine 1 comprises a machine frame 6 supported on rail-based running gears 5, on which a tamping unit 7 is mounted. In addition, the machine 1 comprises a lifting and lining unit 8 for lifting and lining the track panel formed of sleepers 4 and rails 9. A current track position is recorded by means of a measuring system 10.

The tamping unit 7 is attached to the machine frame 6 by means of an adjusting device 11. It comprises a tamping unit frame 12 with guide rods 13 and a plurality of tamping unit segments 14. In a variant not shown, each tamping unit segment 14 is assigned a separate tamping unit frame 12. Each tamping unit segment 14 comprises a tamping tool carrier 15 which is mounted on the associated guide rods 13 in a height-adjustable manner by means of a height-adjustment drive 16. Opposing tamping tools 18 are tiltably mounted on the respective tamping tool carrier 15 in a longitudinal direction of the machine 17.

In addition, a vibration drive 19 is arranged on the respective tamping tool carrier 15 to which the tamping tools 18 are coupled via squeezing cylinders 20. Each tamping tool 18 comprises a pivoting lever 21 with an upper lever arm and a lower lever arm. The pivoting lever 21 is mounted on the associated tamping tool carrier 15 by means of a pivoting joint 22, with the upper lever arm being connected to the associated squeezing cylinder 20. Two tamping tines 23 are usually attached to the free lower lever arm.

Figure 2:
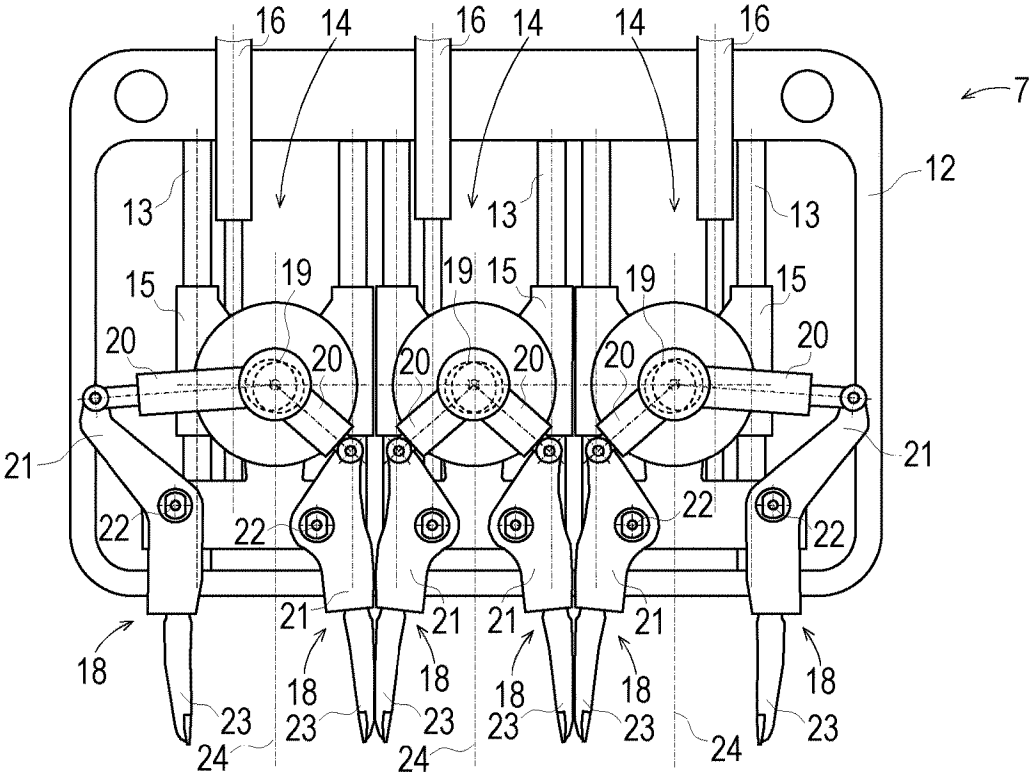
FIG. 2 Tamping unit for simultaneous tamping of three sleepers in side view

In an initial position (FIG. 2), the opposing tamping tines 23 of the respective tamping unit segment 14 have the same spacing in relation to a central vertical plane 24. The spacing between the central vertical planes 24 of the tamping unit segments 14 arranged one behind the other corresponds to the smallest sleeper spacing t of the sleepers 4 to be tamped. The dimensioning of the tamping unit segments 14 in the longitudinal direction of the machine 17 is thus based on this smallest sleeper spacing t.

A middle tamping unit segment 14 arranged between a front and a rear tamping unit segment 14 has a narrow design in the longitudinal direction of the machine 17. This requirement is achieved by means of squeezing cylinders 20 oriented obliquely downwards. In the case of the front and rear tamping unit segment 14, only the half facing the middle tamping unit segment 14 is designed accordingly. The other half has an approximately horizontally oriented squeezing cylinder 20. In this way, a larger pivoting range of the associated tamping tool 18 is given. The increase in the opening width between the opposing tamping tines 23 that can be achieved in this way enables adjustment to larger sleeper spacings t or to twin sleepers to be tamped.

Figure 3:
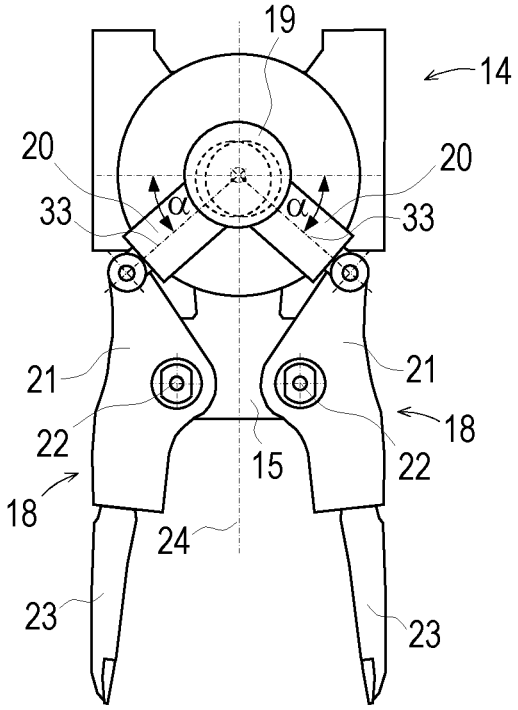
FIG. 3 Middle tamping unit segment in side view
Figure 4:
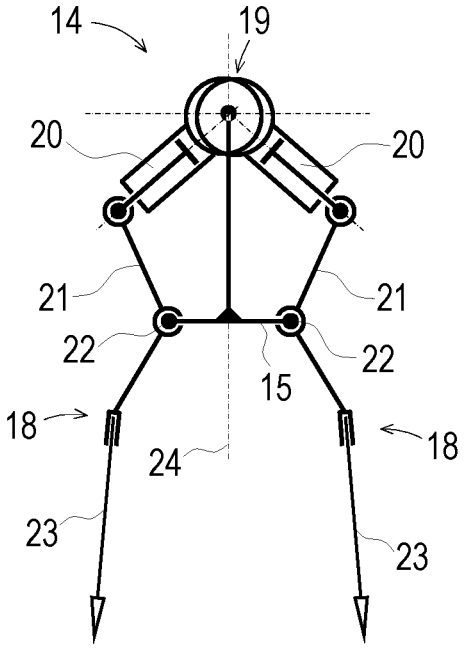
FIG. 4 Kinematics according to FIG. 3
Figure 5:
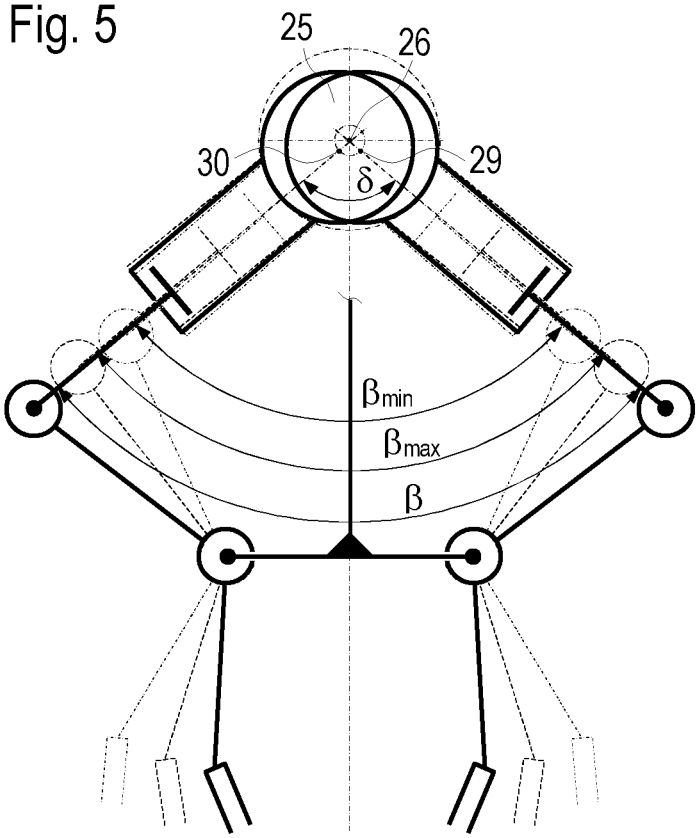
FIG. 5 Kinematics according to FIG. 3 in several working positions

The structure of the middle tamping unit segment 14 is explained in more detail with reference to FIGS. 3 to 5. FIG. 4 shows a kinematic model of the tamping unit segment 14 shown in FIG. 3. FIG. 5 shows the kinematic model 3 in three working positions. On the tamping tool carrier 15, an eccentric shaft 25 of the vibration drive 19 is mounted. During operation, the eccentric shaft 25 rotates around an axis of rotation 26. The eccentric shaft 25 comprises two eccentric discs 27, 28 offset from each other, the axes of symmetry 29, 30 of which have a respective eccentricity $e_1$, $e_2$ in relation to the axis of rotation 26.

In addition, the axes of symmetry 29, 30 and the axis of rotation 26 span two eccentric planes 31, 32, which enclose a relative angle to one another. Cylinder axes 33 of the squeezing cylinders 20 include a position angle. In the case of the middle tamping unit segment 14, the opposing squeezing cylinders 20 are arranged symmetrically. The respective cylinder axis 33 is inclined obliquely downwards at an angle of inclination with respect to a horizontal line. The angle of inclination is at least 20°. Ideally, the angle of inclination is set in a range between 30° and 50° to ensure optimum power transmission in addition to the narrow design.

The angle of inclination and the position angle change slightly during a tamping process as a result of the vibrational movements and the squeezing movements. For better illustration, FIG. 5 shows the various positions of the squeezing cylinders 20 when the eccentric shaft 25 is stationary. The solid lines show a squeezed position of the tamping tools 18. In the position shown, the cylinder axes 33 lie in the eccentric planes 31, 32, so that the position angle is equal to the relative angle. Also for better illustration, the eccentricities $e_1$, $e_2$ are shown disproportionately large compared to the other dimensions. The circular movement of the linkages of the squeezing cylinders 20 resulting during one rotation of the eccentric shaft 25 are not taken into account in the illustration. Their influence on the changes in position of the cylinder axes 33 is negligible compared to the influence of the squeezing movements caused by a piston displacement.

As soon as the eccentric shaft 25 starts to rotate during operation, the eccentric planes 31, 32 will also rotate with an unchanged relative angle □. The position angle □ varies within a range of $□_{min}$-$□_{max}$, which depends on the kinematic design of the tamping unit segment 14 and the piston stroke. During a squeezing process, the squeezing cylinders 20 swivel slightly around the axes of symmetry 29, 30 of the eccentric discs 27, 28. In FIG. 5, the two extreme positions are shown with dashed and dash-dotted lines respectively. The value of the position angle □ always remains approximated to the value of the relative angle □. With optimised kinematic design of the tamping unit segment 14, the value of the relative angle □ is always in the value range $□_{min}$-$□_{max}$ of the position angle □ during operation.

Figure 6:
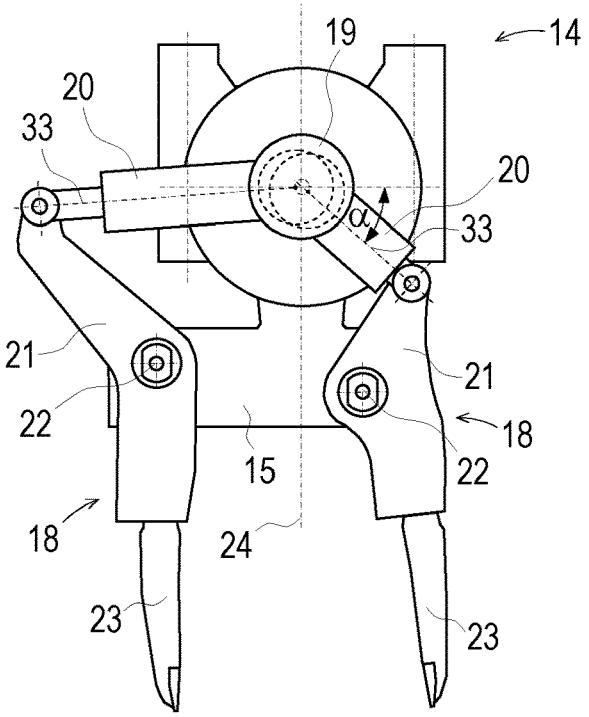
FIG. 6 Front and rear tamping unit segment in side view
Figure 7:
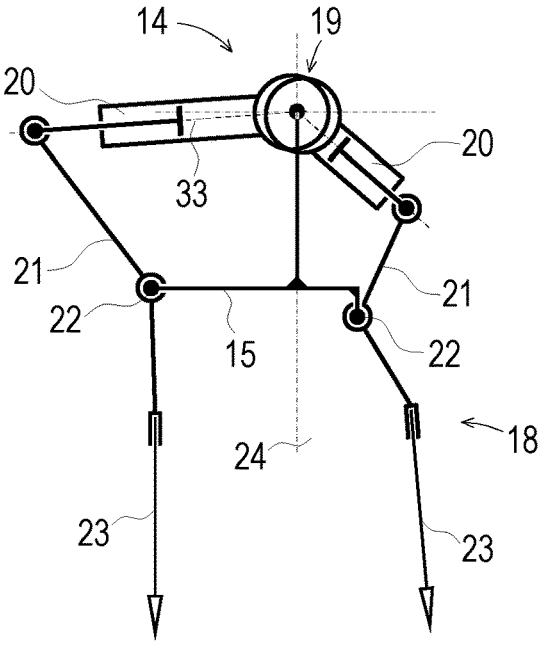
FIG. 7 Kinematics according to FIG. 6
Figure 8:
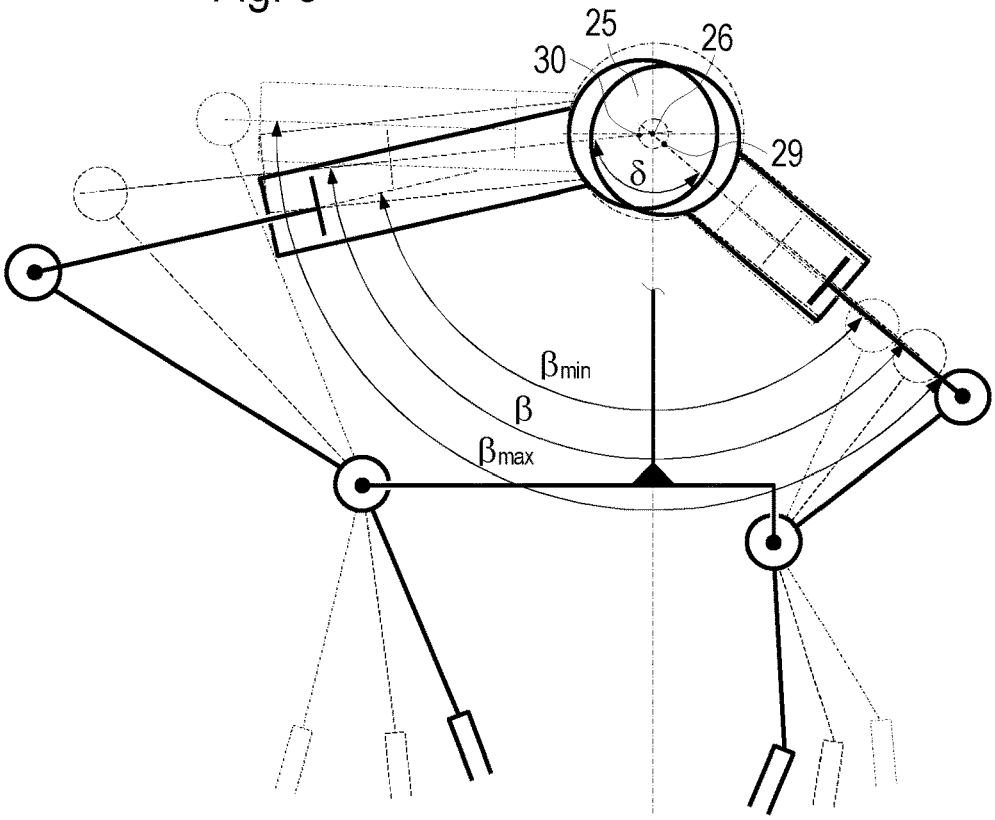
FIG. 8 Kinematics according to FIG. 6 in several working positions

For the front and rear tamping unit segment 14, corresponding kinematic relationships are shown in FIGS. 6 to 8. In contrast to the middle tamping unit segment 14, the squeezing cylinders 20 and tamping tools 18 are arranged asymmetrically here. The pivoting levers 21 assigned to the different squeezing cylinders 20 are adjusted accordingly. On the side facing the middle tamping unit segments 14, the cylinder axis 33 of the squeezing cylinder 20 is oriented obliquely downwards with respect to a horizontal line with the angle of inclination □.

In FIG. 8 it can be seen that the middle positions of the two squeezing cylinders 20 do not occur simultaneously with respect to the respective pivoting range. In the squeezed position shown (solid lines), the shorter squeezing cylinder 20 is in the middle position and the longer squeezing cylinder 20 is in an end position tilting downwards. In this position, the minimum position angle $□_{min}$ occurs. During a return movement of the tamping tools 18, the longer squeezing cylinder 20 passes through its middle position, in which the position angle □ corresponds to the value of the relative angle of the eccentric shaft 25. After the return movement, the position angle has the largest value $□_{max}$. Thus, during a squeezing and return movement, the value of the position angle fluctuates in the range $□_{min}$-$□_{max}$ around the value of the relative angle of the eccentric planes 31, 32.

In order to ensure an approximately equal lever transmission on both sides, the pivoting joints 22 are vertically spaced on the tamping tool carrier 15. The longer design of the almost horizontally oriented squeezing cylinder 20 allows for a greater squeezing distance. As a result, the position angle fluctuates in a larger range of values $□_{min}$-$□_{max}$.

Figure 9:
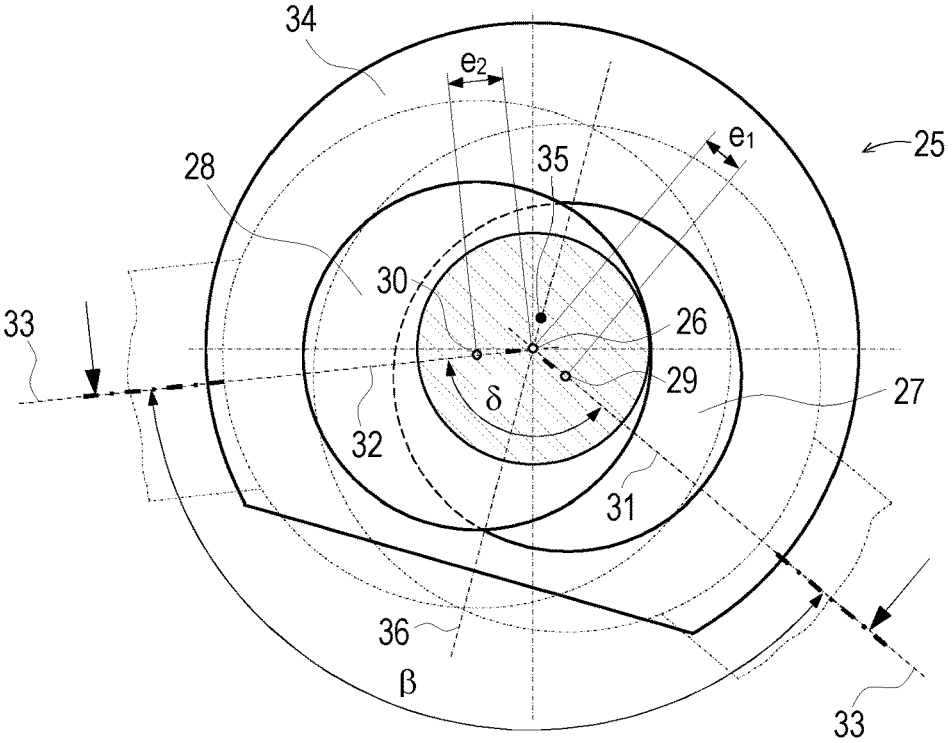
FIG. 9 Eccentric shaft in side view
Figure 10:
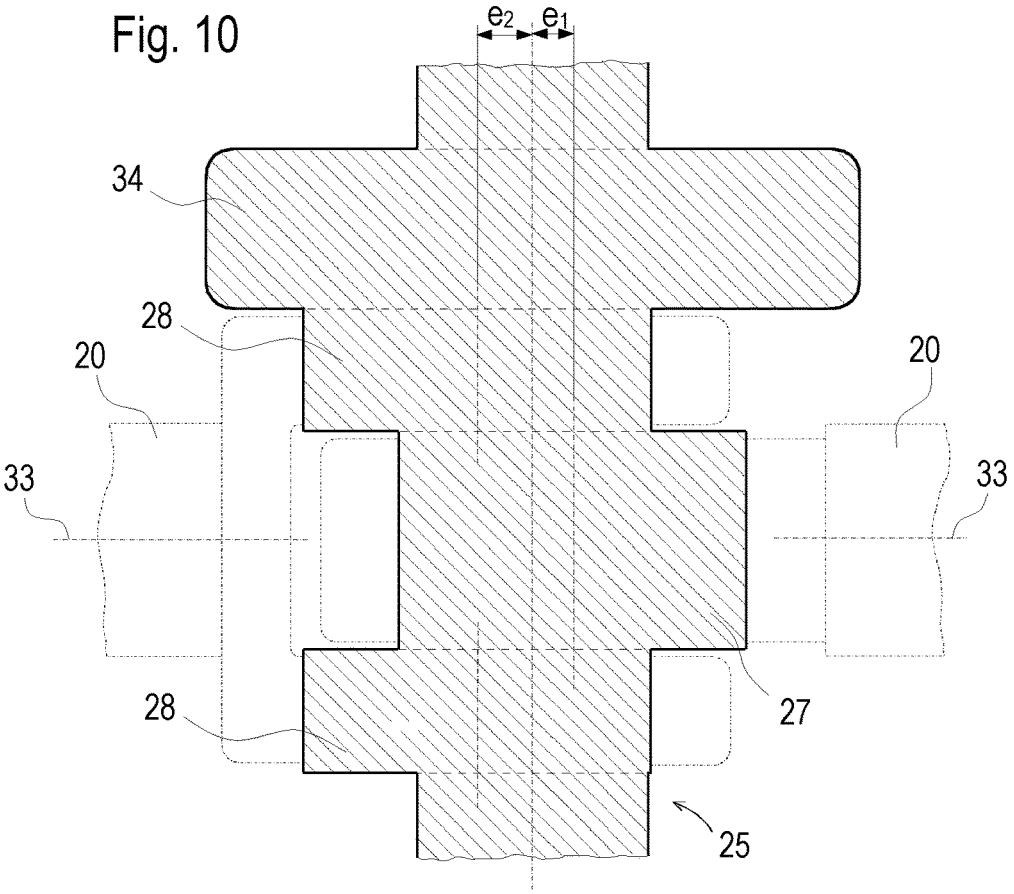
FIG. 10 Eccentric shaft in top view

FIGS. 9 and 10 show the eccentric shaft 25 for the front or rear tamping unit segment 14 in detail. For the sectional view in FIG. 10, the cut is shown in FIG. 9. The first eccentric disc 27 is centred along the eccentric shaft 25. On this first eccentric disc 27, the shorter squeezing cylinder 20 oriented obliquely downwards is mounted. The second eccentric disc 28 is divided into two parts, whereby the partial eccentric discs are arranged on either side of the first eccentric disc 27. The longer squeezing cylinder 20 is mounted with a fork-shaped end on top of it. Both squeezing cylinders 20 are shown in FIGS. 9, 10 with dash-dotted lines.

In the position shown, the cylinder axes 33 of the squeezing cylinders 20 fall within the range of the eccentric planes 31, 32. At that, the vibrations of both squeezing cylinders 20 reach an outer reversal point at the same time. As soon as the eccentric shaft 25 continues to rotate, the ends of the squeezing cylinders 20 mounted on the eccentric discs 27, 28 are moved in an opposite direction. Due to the synchronous vibrations, the vibrating masses balance each other out to a large extent. This applies in particular to the synchronously vibrating tamping tines 23.

The mass balance is reinforced with a flywheel 34, which rotates with the eccentric shaft 25 around the same axis of rotation 26. The eccentric shaft and the flywheel 34 form a rotating unit whose centre of mass 35 lies approximately on a symmetry plane 36 of both eccentric planes 31, 32. Here, the centre of mass 35 is spaced from the axis of rotation 26 and lies opposite the axes of symmetry 29, 30 of both eccentric discs 27, 28. The flywheel 34 with off-centre centre of mass 35 counteracts the inertial forces of the vibrating squeezing cylinders 20. The dimensions of the flywheel 34 are matched with the mass of the squeezing cylinder 20. The flywheel 34, for example, is designed as a disc which, in order to achieve the off-centre centre of mass 35, has a flattened area or a groove.

In the shown eccentric shaft 25 for the front or rear tamping unit segment 14, the eccentricities $e_1$, $e_2$ having different sizes cause equal amplitudes at the free ends of the tamping tines 23. Due to the symmetrical arrangement, both eccentricities $e_1$, $e_2$ at the eccentric shaft 25 for the middle tamping unit segment 14 are of equal size.

Figure 11:
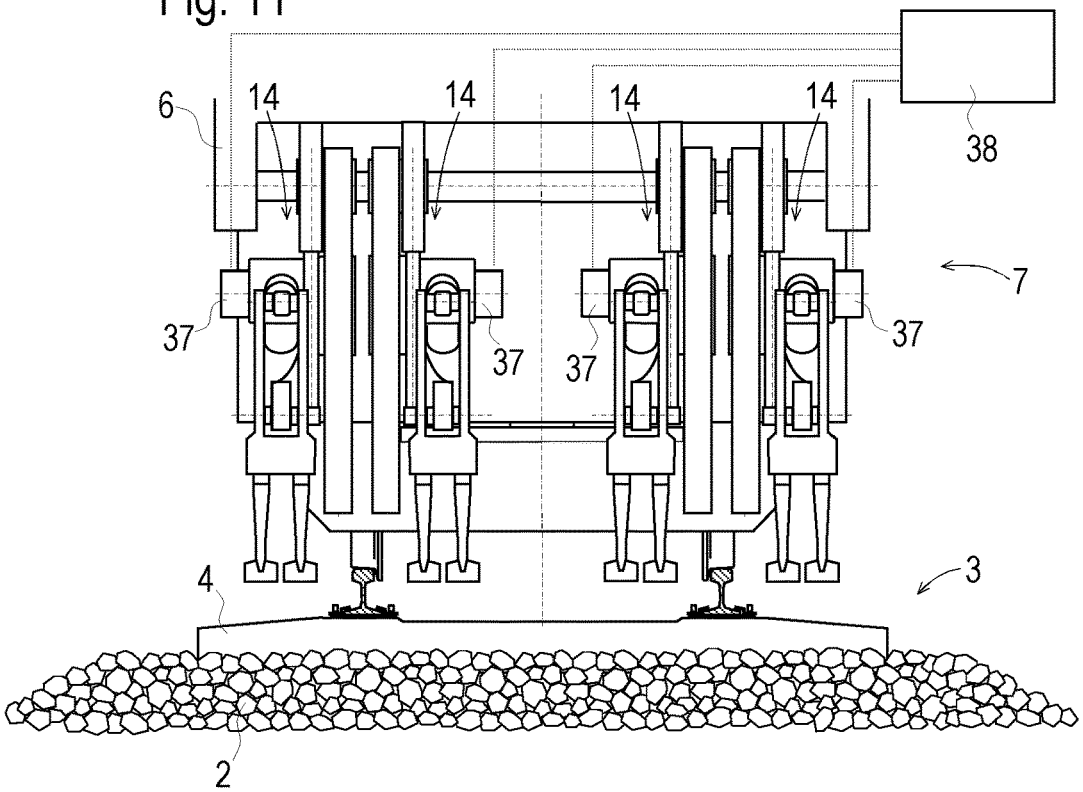
FIG. 11 Tamping unit in front view

FIG. 11 shows that two separately lowerable tamping unit segments 14 are assigned to each rail 9 of the track 3. Thus, the tamping unit 7 comprises four tamping unit segments 14 arranged next to each other in a bank arrangement. For each tamping unit segment 14, the associated eccentric shaft 25 is driven by a vibration drive motor 37. All vibration drive motors 37 are actuated by means of a shared control equipment 38 to ensure a synchronous operation. In this way, the vibrations of the individual tamping unit segments 14 cancel each other out, minimising vibrations transmitted from the tamping unit 7 to the machine frame 6.

In a simplified variant not shown, a combined tamping unit segment 14 with tamping tools 18 on the inside of the rail and tamping tools 18 on the outside of the rail is assigned to each rail 9. In this case, the tamping unit 7 comprises two combined tamping unit segments 14 arranged next to each other in a bank arrangement.

Figure 12:
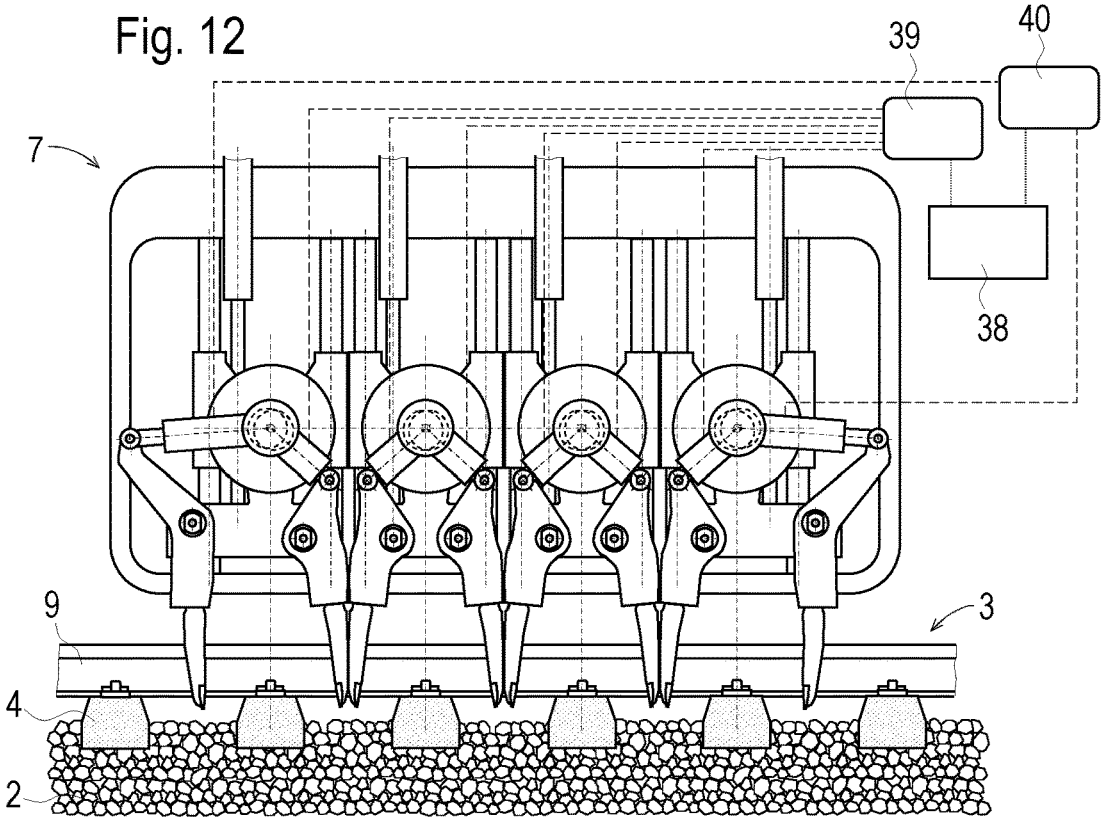
FIG. 12 Tamping unit for simultaneous tamping of four sleepers

For tamping a sleeper 4, the tamping unit segments 14 arranged next to each other form squeezing groups, whose tamping tines 23 are lowered together and squeezed together (two squeezing groups per bank). A tamping unit 7 with four banks of tamping unit segments 14 arranged one behind the other is shown in FIG. 12. This results in eight squeezing groups, each of which is actuated together. The squeezing groups of the middle tamping unit segments 14 and the squeezing groups of the front and rear tamping unit segments 14 facing them are supplied by means of a first squeezing pressure system 39. The foremost squeezing group and the rearmost squeezing group are supplied by means of a second squeezing pressure system 40.

In this way, the differently dimensioned squeezing groups are loaded with different squeezing pressures during a squeezing process. The squeezing pressures are harmonised with each other in such a way that the same static and dynamic squeezing forces are present in all tamping tines 23. To ensure a uniform squeezing process along a sleeper 4, the respective squeezing group is actuated with a shared control signal.

The invention claimed is:

1. A machine with a tamping unit for simultaneously tamping a plurality of sleepers of a track positioned directly one behind another, the machine comprising:

a plurality of tamping unit segments arranged one behind another with respect to a longitudinal direction of the machine;

each of said tamping unit segments including a height-adjustable tamping tool carrier and opposing tamping tools mounted to said tamping tool carrier, and a vibration drive disposed on said tamping tool carrier and coupled to said opposing tamping tools via first and second squeezing cylinders;

said vibration drive including an eccentric shaft with a first eccentric disc and a second eccentric disc, said first and second eccentric discs having axes of symmetry which, together with a common axis of rotation, span two eccentric planes that enclose a relative angle to one another;

said first squeezing cylinder being mounted on said first eccentric disc, said opposing second squeezing cylinder being mounted on said second eccentric disc, and cylinder axes of said first and second squeezing cylinders enclosing a position angle which is approximated to said relative angle spanned by said two eccentric planes.

2. The machine according to claim 1, wherein each said tamping unit segment comprises at least one squeezing cylinder with a cylinder axis that is oriented obliquely downwards.

3. The machine according to claim 2, wherein the cylinder axis of said at least one squeezing cylinder encloses an angle of inclination greater than 20° with respect to a horizontal.

4. The machine according to claim 1, wherein said respective eccentric shaft is connected to a flywheel.

5. The machine according to claim 4, wherein said eccentric shaft and said flywheel form a rotating unit with a center of mass that lies opposite the axes of symmetry of said eccentric discs with respect to the axis of rotation.

6. The machine according to claim 1, wherein said tamping unit comprises front and rear tamping unit segments with asymmetrically arranged squeezing cylinders and middle tamping unit segments with symmetrically arranged squeezing cylinders.

7. The machine according to claim 6, wherein each of said front and rear tamping unit segments has an eccentric shaft with different eccentricities.

8. The machine according to claim 6, wherein each of said front and rear tamping unit segments has opposing tamping tools which are mounted on the associated said tamping tool carrier with vertically spaced pivoting joints.

9. The machine according to claim 6, wherein each of said front and rear tamping unit segments has a half facing said middle tamping unit segments which is constructed according to a symmetry half of said middle tamping unit segments.

10. The machine according to claim 9, wherein said middle tamping unit segments and the halves of said front and rear tamping unit segments facing said middle tamping unit segments are each connected to a first squeezing pressure system, and the halves of said front and rear tamping unit segments facing away from said middle tamping unit segments are each connected to a second squeezing pressure system.

11. The machine according to claim 9, wherein a half of the respective front or rear tamping unit segment facing away from said middle tamping unit segments comprises a squeezing cylinder with a relatively greater stroke for tamping twin sleepers.

12. The machine according to claim 1, wherein a plurality of tamping tools arranged next to each other crosswise to the longitudinal direction of the machine, together with respectively associated said squeezing cylinder, form a jointly actuatable squeezing group.

13. A tamping method, comprising:

providing a machine with a tamping unit according to claim 1; and actuating the vibration drive and the squeezing cylinders of the respective tamping unit segment in such a way that the position angle of the squeezing drives fluctuates within a range around the relative angle of the eccentric planes of the associated eccentric shaft.

14. The method according to claim 13, which comprises driving each eccentric shaft by a respectively associated vibration drive motor, and actuating all vibration drive motors in synchronous operation by a common control device.

15. The method according to claim 13, which comprises actuating squeezing groups that are arranged next to each other crosswise to the longitudinal direction of the machine with a shared control signal.

16. The method according to claim 13, which comprises loading middle tamping unit segments and those halves of the front and rear tamping unit segments that face the middle tamping unit segments with a first squeezing pressure, and loading those halves of the front and rear tamping unit segments that face away from the middle tamping unit segments with a second squeezing pressure during a squeezing process.

* * * * *